US007040021B2

(12) United States Patent
Talavera

(10) Patent No.: US 7,040,021 B2
(45) **Date of Patent: *May 9, 2006**

(54) HAIR TRIMMING DEVICE WITH REMOVABLY MOUNTABLE COMPONENTS FOR REMOVAL OF SPLIT ENDS AND STYLING OF HAIR

(76) Inventor: Victor C. Talavera, 2412 Victoria Cir., Alpine, CA (US) 91901

( * ) Notice: Subject to any disclaimer, the term of this patent is extended or adjusted under 35 U.S.C. 154(b) by 0 days.

This patent is subject to a terminal disclaimer.

(21) Appl. No.: 10/600,155

(22) Filed: Jun. 19, 2003

(65) Prior Publication Data

US 2004/0045168 A1 Mar. 11, 2004

Related U.S. Application Data

(63) Continuation-in-part of application No. 09/844,137, filed on Apr. 27, 2001, now Pat. No. 6,588,108.

(51) Int. Cl.
*B26B 19/44* (2006.01)

(52) U.S. Cl. ..... 30/133; 30/30; 30/124

(58) Field of Classification Search ..... 30/30, 30/123, 124, 133, 194, 195, 205, 206, 233
See application file for complete search history.

(56) References Cited

U.S. PATENT DOCUMENTS

| | | | | |
|---|---|---|---|---|
| 2,674,037 | A | 4/1954 | Swenson | |
| 3,015,336 | A | 1/1962 | Caples | |
| 3,115,143 | A | 12/1963 | Queen | |
| 3,698,403 | A | 10/1972 | Morand | |
| 4,314,405 | A | 2/1982 | Park | |
| 4,868,984 | A | 9/1989 | Elsherbini | |
| 4,958,432 | A | 9/1990 | Marshall | |
| 5,213,116 | A | 5/1993 | Stein | |
| 5,461,780 | A | 10/1995 | Morana | |
| 5,519,939 | A | 5/1996 | Smith | |
| 5,724,736 | A * | 3/1998 | Smith | 30/133 |
| 5,884,402 | A | 3/1999 | Talavera | |
| 6,588,108 | B1 * | 7/2003 | Talavera | 30/133 |

* cited by examiner

*Primary Examiner*—Hwei-Siu Payer
(74) *Attorney, Agent, or Firm*—Donn K. Harms

(57) ABSTRACT

A hand held hair trimming device which when pulled through the hair trims only a determined portion of the ends of hair strands while leaving adjacent hairs uncut. The device will cut a predetermined length off only the distal ends of the hair shafts each time it has the hair drawn through one or a plurality of serpentine pathways formed by retainer cavities and an engageable retainer. The cutting head portion of the device may be removed and replaced and optional hair dryer or vacuum may be attached to an aperture on the rear of the cutting head to dry hair, vacate cut ends, or encourage distal ends of hairs toward the cutting blade.

33 Claims, 5 Drawing Sheets

HAIR TRIMMING DEVICE WITH REMOVABLY MOUNTABLE COMPONENTS FOR REMOVAL OF SPLIT ENDS AND STYLING OF HAIR

This applications is a continuation in part of U.S. patent application Ser. No. 09/844,137, filed Apr. 27, 2001 now U.S. Pat. No. 6,588,108.

BACKGROUND OF THE INVENTION

1. Field of the Invention

The present invention relates to an improved device for the trimming of the hair. More particularly it relates to a device which will trim a predetermined substantial equal amount from the ends of the individual hair shafts distal from the hair follicles for removal of the split ends and damaged hair ends derived from frequent combing and washings. The predetermined lengths of the hair shafts are thus trimmed while leaving adjacent longer hair shafts intact. The device also features removable blade mechanisms for user adjustment of hair trim length and optionally hair drying.

2. Prior Art

Because of the changing styles and the inevitability that the hair on a person's head will grow and need to be cut, visits to hairstylists and barbers are a common occurrence in the United States and throughout the world. Hairstylists and barbers are trained in the art of cutting hair to their clients' specifications using motorized and hand held implements such as scissors and electric clippers. Sometimes the person desires a new hairstyle, but more often they are happy with the hairstyle and only require a given amount cut from the ends of the hair shafts. However, one vexing problem exists whether the hair on a person's head is being cut by a trained stylist of the individual needing the trim or by an amateur, and that is that split ends and damaged hair ends must be removed to keep the hairstyle looking good. Split ends and damaged hair ends are a constant and continuous product of combing and brushing of hair, sun rays, hair coloring, blow drying, etc. and they can cause the hair to look unhealthy as well as just unfashionable.

The current method of trimming split ends and damaged hair ends either by the highly trained stylist or the amateur involves a time-consuming process. The hair must be stretched relatively taut using the hand or a comb or combination thereof, and then only the ends of the individual hairs distal from the follicles on the scalp are delicately trimmed. An errant cut will yield harsh marks, uneven cuts, or other undesired results in the head of hair of the person receiving the hair cut.

Split ends and damaged hair ends are an especially vexing problem in the case of hair shoulder length and longer in styles worn by women and men. Because of the varying length of the strands of hair involved from the ears down to the shoulders or below, it is especially time-consuming to try to trim only the ends of the hair, a very small relatively equal amount, while not accidentally cutting long adjacent strands. This process is made even harder when the style of cut is tapered through the length and just the short ends require cutting maintaining the tapered style. Hours can be spent by professional hair stylists trying to trim the split ends on a person's long hair. It is virtually impossible for a person with long hair to trim the split ends and damaged hair ends themselves, as cutting the split ends of the hair on the back of one's head using a mirror and scissors is a task fraught with peril. One slip and the hairstyle could be ruined by cutting some long strands of the hair laying adjacent to the distal split ends or damaged hair ends on shorter hair shafts.

A number of devices have been developed over the years for trimming hair to be used by amateurs and professional hair stylists alike. Such devices attempt to allow amateurs to cut hair into professional looking styles or to enhance the ability of professional stylists by giving them another tool for their trade. While many of these devices address the issue of cutting hair and styling it, few devices address the issue of split ends and damaged hair ends on the distal ends of the hair and removing only a predetermined short length of the unhealthy distal ends. Further, on very long hair, even if the ends are not split, all hair does not grow at the same rate and the aged distal hair shaft ends are often removed as a cosmetic aid to beautifying the head of hair getting rid of frizzy and unattractive hair ends. To remove such damaged or unattractive hair shaft ends without ruining the hair style of the individual or causing major change in styles requires that only the short pieces of the distal ends of the hair shafts be cut off without disturbing longer adjacent healthy normal appearing hair shafts. This can be a very tedious if not an impossible task with the thousands of hairs on an individual's head.

U.S. Pat. No. 5,519,939 (Smith) teaches a combination of a rotating brush, comb and razor blade arranged to cut a broad swath of hair when in use. However, Smith requires many adjustments by the individual using the device and it is intended to cut long pieces of hair as determined by the circumference of the rotating brush. This device, because of its arrangement cannot be configured to cut only a short length of hair from the distal ends of the hair shafts in relatively equal amounts as required to trim split ends and unhealthy or unattractive hair ends. Further, because it is drawn through the hair by hand to rotate the brush, the user is in constant peril of having hairs wrap around the brush into a tangle or of pulling the device sideways through the hair and accidentally cutting off broad swatches of adjacent hair. Often these razor blade cutters pull the hair to cut, rather than shearing action for hair for removal. This pulling may produce a great deal of discomfort for the individual receiving the hair cut.

U.S. Pat. No. 3,115,143 (Queen) teaches of a guide for trimming hair whereby a user can taper or feather the cut of the hair from the neckline to the temples. This device, however, requires holding the guide in one hand and the electric clippers in the other. Such an arrangement precludes use by an individual in cutting his or her own hair and requires constant attention and the skill of a stylist or second person to cut the hair on which the device is being used. It would be virtually impossible for a user to cut the hair on the back of his or her own head in this manner, and Queen's patent by its own teaching addresses tapering and feathering of haircuts rather than just the removal of split ends. Further, it would be virtually impossible without great effort and time to cut only a substantially equal portion from the distal end of individual hair strands while leaving adjacent longer hair strands untouched with this device.

U.S. Pat. No. 5,213,116 (Stein) teaches of a hair trimming device using a rotatable blade on a comb like guide. This device is, however, designed to cut bangs rather than split ends, and because as taught it requires two hands to use it, it is unlikely that anyone could use this device on the back of the head without the aide of another individual to guide the device. Again, trimming substantially equal amounts from the distal ends of hairs would be extremely time-consuming and require great dexterity if it could be accomplished.

U.S. Pat. No. 5,884,402 (Talavera) teaches of a unique device that accomplishes the difficult task of cutting only the distal ends of the hair strands and can be used by a trained hair stylist or an amateur. This hair trimming device can also be used by a single individual, with some limitations. The motor driving the cutting blades is taught as only spinning in one direction allowing that the instrument must be used in the right hand only and the hair needs to enter on one side only. Also the limited hair guides on the face of the device, while functional, do not necessarily allow that the hair always follow a straight path over the roller when passing through the device and the cutting blades require a better shearing action to effectively cut the distal ends of the hair strands.

Thus, there is a continuing need for improvement in devices used in the field of hair styling, in particular where cutting split ends and trimming a predetermined length off the ends of the hair is required.

SUMMARY OF THE INVENTION

The applicant's device is a component interchangeable hair maintenance tool which provides a user configurable hair trimmer used for trimming substantially equal short pieces of hair shafts which form split ends or unattractive or unhealthy hair ends. Various components may be added or traded onto the device to change the length of hair trimmed, dry the hair, or allow for the use of shears to cut certain portions of the hair if desired. The split end or damaged hair ends cutting operation takes place by only removing the distal ends of the hair, while leaving adjacent shafts of longer hair lengths uncut until the device reaches the distal ends of those strands.

Several improvements incorporated into the operation of this device serve to enhance or improve that operation. These improvements include interchangeable components which may be removed or substituted to change the length of hair trimmed, allow for hand trimming, or drying the hair while concurrently straightening it. When sold or provided for use in a kit form, the improvements provided by the various components can be interchanged by the user to yield the desired outcome. These improvements all enhance the ability of the device when used in conjunction with the novel serpentine movement of the hair through the device whereby the ends of the hair shafts flip up into the cutting blades as they pass over the central structure of the hinged retainer, while the longer hair shafts remain held against the retainer central section until they reach their distal ends.

With the improved unit the hair shafts are held against an angular pressure unit by the means of the operator pressing the retainer-activating lever against the handle to raise the hinged retainer into the operating position. The degree of angle on the angular pressure unit determines how long the strands of hair are retained before the ends flip up into the blade of the cutter assembly. Several different degrees of angle are available on the pressure unit so that different lengths of hair may be cut off. The angular pressure unit slides in and out of the cutter head by the means of two or more dovetails formed on the sides of the retainer cavity or cavities. Two matching dovetail grooves in the angular adjustment unit allow that a number of different units with different angles be used in the device. With the novelty of this incorporation, as the hair passes through the serpentine channel of the device, the individual may by the means of the cut length adjustment mechanism, determine the precise amount of hair that is removed from the hair shafts.

A unique hair cutting assembly component and drive system has been created whereby a rotational direction switch determines both on and off and the direction the motor will drive the cutting blade. In doing this the hair trimmer may be held in either hand, with the hair passing through the serpentine hair channel form left to right or from right to the left. The removable cutter assembly retained in the cutter head has an internal gear drive wheel attached to the cutter blade that rotates within a blade frame held in place by a bushing at either end. The drive motor within the cutter body has a gear system with a fixed gear that extends out to engage the internal gear wheel on the cutter assembly. Two shear plates mounted on each side of the frame allow that the blade may rotate in either direction and cut effectively. The shear plate(s) have a retaining edge and two retaining tabs to hold them in a precise location on the blade frame, while the shearing edge turns down to engage the shearing edge of the cutter blade. Mounting the shear plates to the blade frame is accomplished by the means of multiple self-tapping screws or other attachment means that translate through flex rings enabling the shear plates to be flexible and maintain a uniform pressure against the cutting blade edge surfaces.

The hinged hair retainer that rotates into the retainer cavity of the cutter head has typical side configurations of a brush head. Each side incorporates a plurality of splines along the outermost edge and a series of ridges located on the flat surface insuring that the hair is retained in the plurality of splines of the detachable spline units attached to the cutter head. The detachable spline units will be available in sets with varying number and length of splines, along with different degrees of flexibility in the composition of the plastic or other flexible material from which they are made.

The hair retainers' central structure where the hair rotates around to flip up into the cutter blade has a smooth curved surface and a plurality of teeth maintaining the straight flow of the hair shafts through the serpentine hair channel or channels. Hair trimming may also be accomplished without the aide of the detachable spline units, allowing the hair to pass directly over the surfaces of the cutter head with the hair being guided by the splines and teeth on the hair retainer only.

The cutter head assembly can be provided as a single attachable unit or in kit form with a plurality of head assemblies each having a plurality of small raised ridges that engage in a continuous slot around the mating end of the cutter body holding it securely in position but allowing that it may be removed with a slight axial pressure. The cutter head consists of two or more side lobes with the retainer cavity between. Each of the side lobes has multiple orifices for attaching the detachable spline units with the retainer cavity located between the lobes, and a single top lobe with a removable transparent door for cleaning the cut hair ends from the internal containment area. A locking pin translates outwardly from the cutter body above the cutter assembly adjacent to the mating ends, through an orifice in the cutter head and a matching orifice in the end of the transparent door. The locking pin insures that the door is closed when the cutter blade assembly is connected to the motor providing a means for safety closure for the device since the blade will not operate unless properly seated depressing the pin. Another safety protection is a grill in the retainer cavity that the hair flips up through to engage the cutter blade. The grill has, but is not limited to, 0.375 inch spaces and will not allow enough room in which to insert a finger into the cutting blade. Another benefit that the grill offers is that it prevents hairs from entering the blade sideways and getting cut longer than what is intended.

The cutter body houses one or a plurality of electric drive motors for the cutter head. It also retains the pivot mechanism for the hair retainer and the retainer-activating lever. The rotational direction switch is located conveniently where it may be activated with the thumb while the fingers work the retainer-activating lever. In the handle mating cavity there will be two power prongs and a ground prong with mating orifices in the handle when the device is used with a house power connection cord or as shown with two power contacts when used with batteries or a rechargeable sealed power handle.

Another embodiment of the device would feature the cutter body assembly having multiple parallel side lobes extending from the body assembly opposite the handle attachment to the body assembly. This embodiment would feature mounting pins on the rear side of the side lobes on a side opposite the slot. These pins would provide mounts for attachable blade assemblies, a hair drying component, or when such components are removed, access to the hair communicating through the slot so that the ends may be shear trimmed by hand if desired.

It is an object of this invention to create a hair trimmer that can cut a more precise length of hair off the distal end of hair strands.

Another objective of this invention is to create a device that can be operated by an individual in either hand, and draw the hair through the serpentine channel in either direction by the means of adjusting the direction of the rotation of the electric motor with a switch.

Another objective of this invention is to create a device with a means of continuous control of the hair passing through the serpentine channel or channels made possible by the splines on the hair retainer, the splines on the detachable spline units, and the teeth on top of the retainer central structure.

Still another objective of this invention is to supply a cutter with different length adjustment mechanisms that can guarantee the precise lengths of the trimmed ends of the hair shafts.

An additional object of this invention is to design a unique cutting blade assembly that can cut equally well in either direction of rotation with a means of flexible resistance on the two shearing surfaces.

Further objectives of this invention will be brought out in the following part of the specification, wherein detailed description is for the purpose of fully disclosing the invention without placing limitations thereon.

BRIEF DESCRIPTION OF DRAWING FIGURES

FIG. 1 is a perspective view of the hair trimming device with the cutter head assembly, cutter blade assembly and the handle, exploded away from the cutter body. The retainer-activating lever and the hair retainer are in the relaxed open position. The hair removal door which is preferably transparent and one of the detachable spline units are shown exploded away from the cutter head assembly.

DETAILED DESCRIPTION OF PREFERRED EMBODIMENTS OF THE DISCLOSED DEVICE

Figures 1, 2:
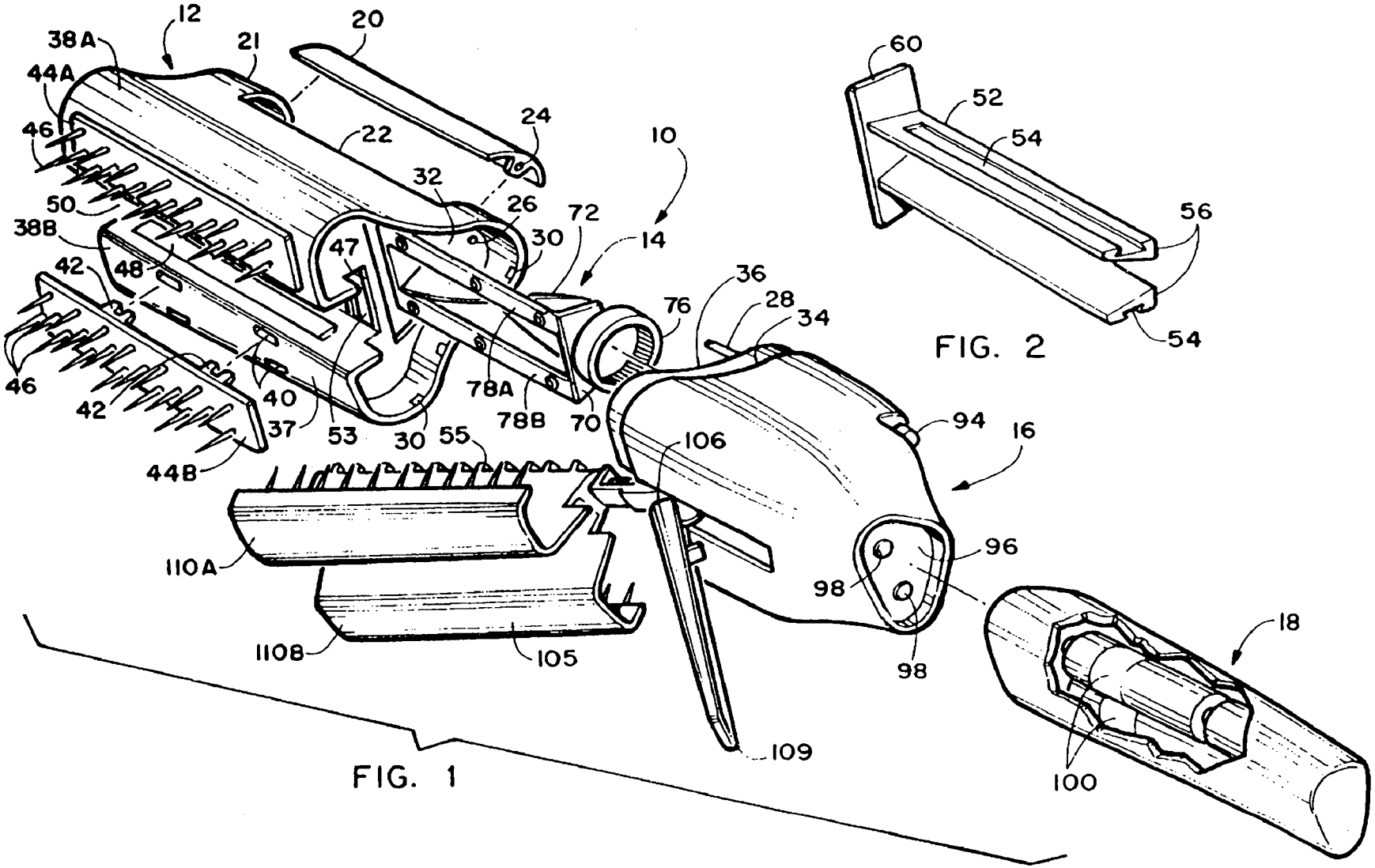
FIG. 2 is a perspective view of the cut length adjustment mechanism.

Referring now to the drawing FIG. 1 showing an exploded perspective view of the hair trimmer assembly 10, the cutter head assembly 12, the cutter blade assembly 14, the cutter body assembly 16 and the handle 18 are the major components of the hair trimmer assembly 10. The cutter head assembly 12 is shown with the transparent or non-transparent hair removal door 20 exploded away from the top lobe 21 of the internal containment area 22 that holds the cut ends of the hair shafts 23 drawn through the device and trimmed. The locking orifice 24 in the end matches the orifice 26 in the cutter head that is in alignment with the locking pin 28 located in the cutter body 16 so that when the cutter head assembly and the cutter body are assembled, the hair removal door 20 cannot be removed thereby providing a means to prevent access to the internal containment area 22 during operation of the device 10.

A plurality of raised ridges 30 around inside perimeter edge of the female end 32 of the cutter head assembly 12 provides a means of registered engagement of the cutter head assembly 12 to the cutter body 16 for attachment thereto using a continuous recess 34 around the inner edge of the male mating end 36 of the cutter body 16 and thereby retaining the two parts together under normal operation. A slight axial pressure will disengage the cutter head 12 from the cutter body 16. Once so removed, the hair removal door 20 can be taken off the cutter head assembly 12 to allow for cleaning the internal containment cavity 22 as a reservoir for the distal ends cut from the cut hair shafts 23.

The face 37 of cutting head assembly 12 has two side lobes 38A and 38B have orifices 40 for engaging the locking tabs 42 of the detachable spline units 44A and 44B. The detachable spline units 44A and 44B will be available in sets, with a varying number and length of splines 46 along with different degrees of flexibility in the composition of the plastic or other flexible material from which parts can be made. Of course the splines 46 could also be formed into the two side lobes 38A and 38B if removability is not desired; however, the current best mode employs removable spline units 44A and 44B.

For the safety of the operator a grillwork 47 has been incorporated in the elongated slot 55 of the retainer cavity 50. This grillwork 47 features grill apertures 53 therein thereby allowing enough room for the distal ends of hair shafts 23 to communicate therethrough for cutting by the cutting blade 72, but not enough room to insert a finger or for longer hairs to wrongly enter the blade sideways and get unevenly cut. This provides a safety means to eliminate potential injury of the user's finger by the cutting blade 72. The grill apertures 53 formed in the grillwork 47 also provide a means for hair alignment of the distal ends 25 of the hair shafts 23 with the cutting blade 72 by providing communication through individual apertures in the grillwork 47 to prevent distal ends of hairs 25 from encountering the cutting blade 72 at angles thereby aligning the distal ends of hair shafts 23 communicating therethrough with the cutting blade 72.

The hinged hair retainer 105 rotates into the retainer cavity 50 formed between the side lobes in the cutter head assembly 12 by means of the pivot mechanism 106 when retainer-activating lever 109 is compressed by the fingers of the operator against the cutter body 16 or it could be spring loaded to be so compressed with the operator therein opening raising the hair retainer 105 by pressing the lever 109; however, the current best mode features the configuration whereby the user compresses the hair retainer 105 into the retainer cavity 50. The hair retainer 105 consists of at least two or multiple matching sides 110A and 110B that operatively engage with lobes 38A and 38B of the cutter head assembly 12. The outer edges 112 of the matching sides 110A and 110B have a plurality of splines 114 to guide the hair shafts 23 through the serpentine hair channel 58. The surface of the hair retainer 105 adjacent to the slot 55 when the hair retainer 105 is recessed into the retainer cavity 50 in the current best mode has a plurality of ridges 51 with gaps in between each ridge 51 which line up with the grill apertures 53 and form a plurality of serpentine pathways for hair to traverse through the device 10 in use. Engagement of the ridges 51 with the grill also serves to maintain the hair shafts 23 in a substantially straight path through the device thereby avoiding the potential for angled communication of distal ends 25 of hair shafts 23 with the cutting blade.

Figure 4:
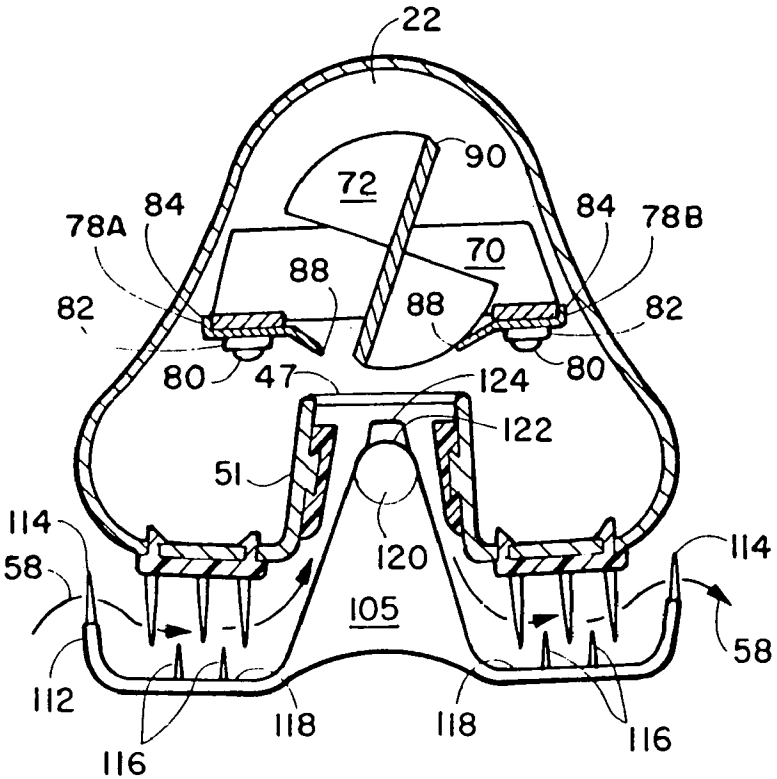
FIG. 4 is a section through the cutter head assembly and cutter blade assembly with the hair retainer not shown in cross section.
Figure 3:
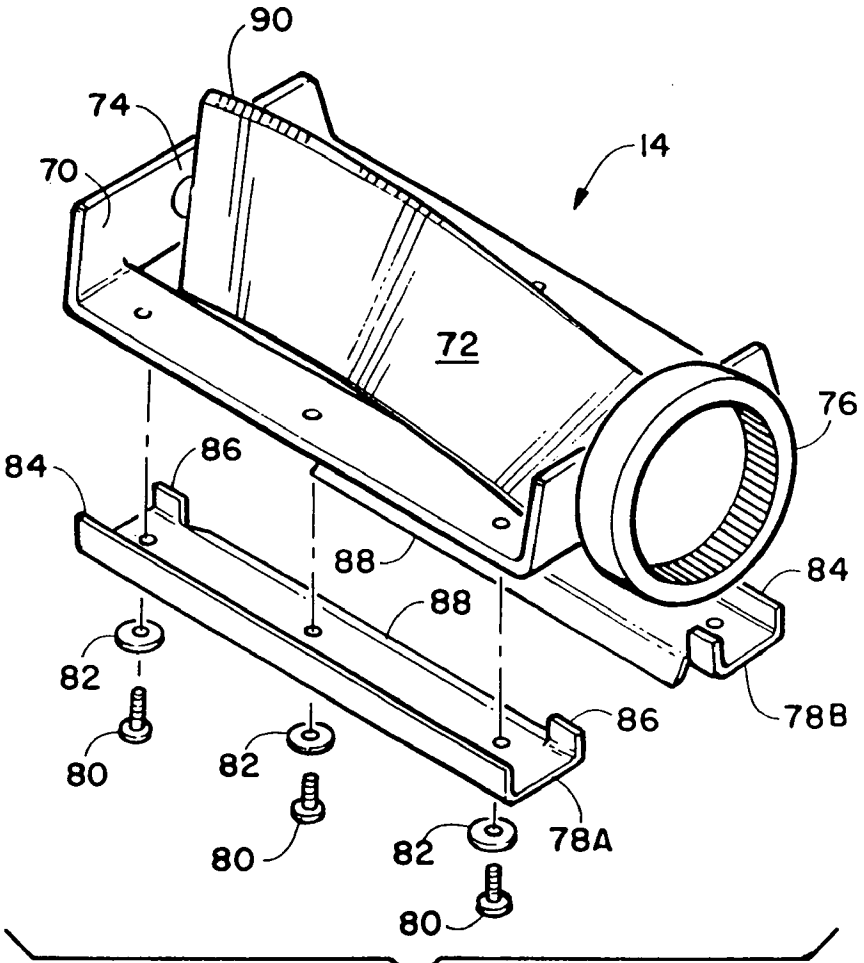
FIG. 3 is a perspective view of the cutter blade assembly showing the two or multiple shear plates exploded down with the rubber flex rings and mounting screws.

The opposing sides surfaces 107 of hair retainer 105 are angled to cooperatively engage the angular pressure sides 56 of face plate 60 and compress the hair shafts 23 traveling in the serpentine channel 58 thereby tensioning the hair shafts 23. Compressing the hair retainer 105 into the retainer cavity 50 thus imparts tension to hair shafts 23 being pulled through the serpentine hair channel 58 formed by the cooperatively engaged hair retainer 105 and retainer cavity 50. Splines 46 of the detachable spline units 44A and 44B, are located on the flat surface 118 (FIG. 4) of the hair retainer 105 and engage the flat surface 118 of the cooperatively engaged hinged retainer 105 and help to form defined paths in between the splines 46 and the teeth 124 on the surface of the hair retainer 105 for the tensioned hair shafts 23 to travel, thereby keeping the hair shafts 23 traveling in the serpentine hair channel 58 running in a straight path while traversing the device 10 during use. This straight path alleviates any potential of distal ends of hair shafts 23 accidentally angling during travel through the serpentine hair channel 58 and causing too much of the distal ends to be cut by the cutting blade 72.

The hair central structure 120 (FIG. 4) of hair retainer 105 over which tensioned hair shafts 23 travel thereby causes the distal ends of these hair shafts 23 to flip up and through the elongated slot 55 and to be cut between the flexible shearing edge 88 and cutter blade edge 90 when tension on the distal ends is momentarily relieved once the distal ends loose contact between the hair retainer 105 and angular pressure sides 56. The central structure 120 has a smooth curved surface 122 and defined radius and in the current best embodiment a plurality of teeth 114 help maintain a straight flow of the hair shafts 23 in the defined path through the serpentine hair channel 58 and urge the distal ends of the hair shafts 23 through the adjacent grill apertures 53 adjacent thereto where they may be cut a determined length. Registering the positions of the grill apertures 53 and teeth 114 such that the teeth 114 are inline with the metal portion between the grill apertures 53 further channelizes the defined path for the hair shafts 23 traversing the device 10.

A dovetail 48 is incorporated on either side of the retainer cavity 50 to facilitate the incorporation of one means to adjust the cut length of the hair removed from the distal ends of hair shafts 23 communicated through the elongated slot 55 and to the cutting blade 72 in the form of the cut length adjustment mechanism 52. The cut length adjustment mechanism in this embodiment features dovetail grooves 54 in the two angular pressure sides 56 allow the mechanism to slide in place over the dovetails 48 in the retainer cavity 50. Different angles formed on the pressure sides 56 will change the pressure imparted to the hair shafts 23 being drawn through the serpentine hair channel 58. This is because tension upon the hair shafts 23 is proportional to the amount of surface area of the pressure sides 56 which contacts the hair retainer 105 when cooperatively engaged. Changing the angle of the pressure sides 56 thus changes the contact surface area and adjusts the tension on the hair shafts 23. More tension on the hair shafts 23 and a longer surface area contact will cause a shorter distal end to communicate with the cutting blade 72 and conversely less surface area contact will cause a longer strand to communicate with the cutting blade 72 since the distal end of the hair shafts 23 will lose contact earlier and pop up through the elongated slot 55 when tension is lost. The faceplate 60 retains the two angular pressure sides 56 and encloses the end of the retainer cavity 50. A plurality of such faceplates 60 could be supplied or available for use with the device 10, each having differently angled sides 56 to provide differing surface area contact and hence different tension and release points on the hair shafts 23 drawn through the serpentine hair channel 58, thereby adjusting the amount of hair trimmed from the distal end of hair shafts 23 drawn therethrough.

The cutter blade assembly 14 slides within the inner containment area 22 of the cutter head assembly 12. In some cases the cutter blade assembly will be permanently in place within the internal containment area 22. Cutter frame 70 holds the cutting blade 72 between two bushings with the internal gear drive wheel 76 mounted axially on the outside of the frame 70. Two shear plates 78A and 78B mount to the frame 70 by means of mounting screws 80 or any other means of mounting translating through flex rings 82. Shear plate retainer edge 84 and two shear plate retainer tabs 86 keep the shear plates 84 in a precise location. The flexible shear plate edge 88 and the cutter blade edge 90 perform the shearing action required to effectively cut the hair shafts 23 at the ends. With the opposing locations of shear plate 78A and shear plate 78B and the unique configuration of the cutting blade 72 the cutting action will work in either direction of rotation that the drive motor 101 is turning. The use of the shear plates 78A and 78B provide an additional means to adjust the cut length of the hair removed from the distal ends of hairs communicated through the elongated slot 55. Varying the thickness of the shear plates 78A and 78B will move the cutting blade 72 closer to or further from the distal ends of hairs communicated to the cutting blade 72 and thus provide a means to adjust this cut length. Consequently, the device could be provided with a plurality of differently configured cutter blade assemblies 14 each having shear plates configured to move the cutting blade 72 closer to or further from the elongated slot 55 through which the distal ends of hairs are communicated to the cutting blade 72. Moving the same blade assembly up or down is another way to determine the hair length to be cut.

The cutter body 16 houses the conventional drive motor 101 and gear system to cooperatively engage and drive the cutter blade 72 through the internal gear wheel 76. A means to change the rotation direction of the cutter blade 72 is provided by a rotational direction switch 94 which reverses the direction of the DC current provided to the drive motor 101 and is conveniently located at the top of the unit to be activated by the thumb. Of course those skilled in the art will recognize other manners of reversing the direction of the motor 101 and such are anticipated. Changing the motor 101 rotation direction, while not imperative, enhances the function of the device in the current best mode in that it allows the device 10 to be used by either hand of the user by spinning the cutting blade 72 in the correct direction for the direction in which device 10 is being pulled. This is required because the user pulling with his left hand must flip the device 10 over when using it with the right hand and the cutting blade 72 being a rotating scissor, much like hand scissors, works best when cutting in one direction in relation to the direction the device 10 is being pulled.

Another means to adjust the cut length of the hair removed from the distal ends of hair shafts 23 communicated through the elongated slot could be provided using an embodiment of the device wherein the cutter head assembly 12 and the cutter blade assembly 14 are provided as a single unit cutting head attachable to the cutter body assembly 16. In this embodiment a plurality of single unit cutting heads would be provided, each configured with the cutting blade 72 closer to or further from the elongated slot 55 thereby cutting a determined amount of the distal end of hair shafts 23 communicating through the elongated slot 55. By providing a plurality of differently configured single unit cutting heads in a kit form, the user simply needs to mount the appropriate single unit cutting head to the body assembly 16 and can change the length of the distal ends of hair shafts 23 cut by changing to a differently configured single unit cutting head.

As depicted, the handle mating cavity 96 houses the electrical connections 98 which communicate with the electric motor 101 in the cutter body assembly 16. The power communicated would be from batteries 100 in the handle 18 or a transformer connected to conventional AC power. In the preferred embodiment of the device the batteries 100 are housed in the handle 18 and are disposable batteries or a sealed rechargeable battery which would recharge in a conventional fashion by engagement with a charging stand. The handle 18 has an attachment end which locks into cavity 96 of the cutter body assembly 16 to be removed by a slight axial pressure.

While the device is depicted featuring a handle 18 cooperatively engageable with a cutter body portion 16, the two could both be a single unit of unitary construction and still yield the functional benefits of the device as the detachable cutter head 12 and/or removable cutter blade assembly 14 still would allow for easy change of the amount of hair cut from the distal ends of the tensioned hair shafts 23 traversing the serpentine hair channel 58.

Figure 5:
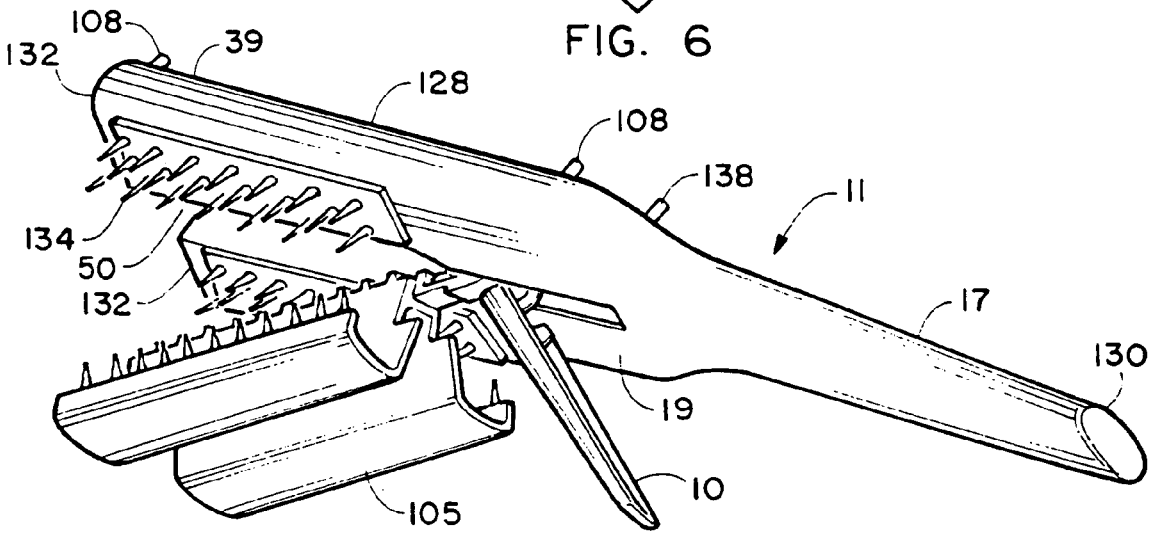
FIG. 5 depicts another modular embodiment of the device with a removable shear assembly allowing replacement of differently configured shear assemblies or use of scissors.

FIG. 5 depicts another embodiment of the disclosed device which allows for the ability to detach and change the cutter blade assembly 14 through the attachment of a cutting unit 126 having the motor 101 cooperatively engaged with a cutting head assembly 12 and cutter blade assembly 14 and batteries 100 all mounted in a single cutting unit 126. Electrical contact with the switch 94 would be provided by cooperatively engageable electrical contacts 138 on the cutting unit 126 and the forks 132. The same contacts 138 could also be used to provide communication to the charger for batteries in the cutting unit 126 or from batteries 100 in the handle 130. This embodiment would still give the advantages of a detachable cutter blade assembly 14 and the ability to adjust the distance of the cutting blade 72 to change the length of hair cut from the distal ends of hair shafts 23 with the additional benefit of being able to detach the cutting unit 126 and use scissors should such be desirable in some instances. This embodiment would feature a one piece body 128 having a handle 130 at one end and a pair of forks 132 defining a cutting slot 134 between the forks 132. In use, the cutting unit 126 would operatively engage the back side 136 of the forks 132 opposite the front side of the forks which would engage with the hair retainer 105. Hair shafts 23 would thus follow the same serpentine path on the front side of the forks 132 and pop up in the cutting slot 134 to be cut by the attached cutting unit 126, or in certain instances the cutting unit 126 might be left off and scissors could be used to cut the distal ends of hair shafts 23 rising through the cutting slot 134.

Figure 6:
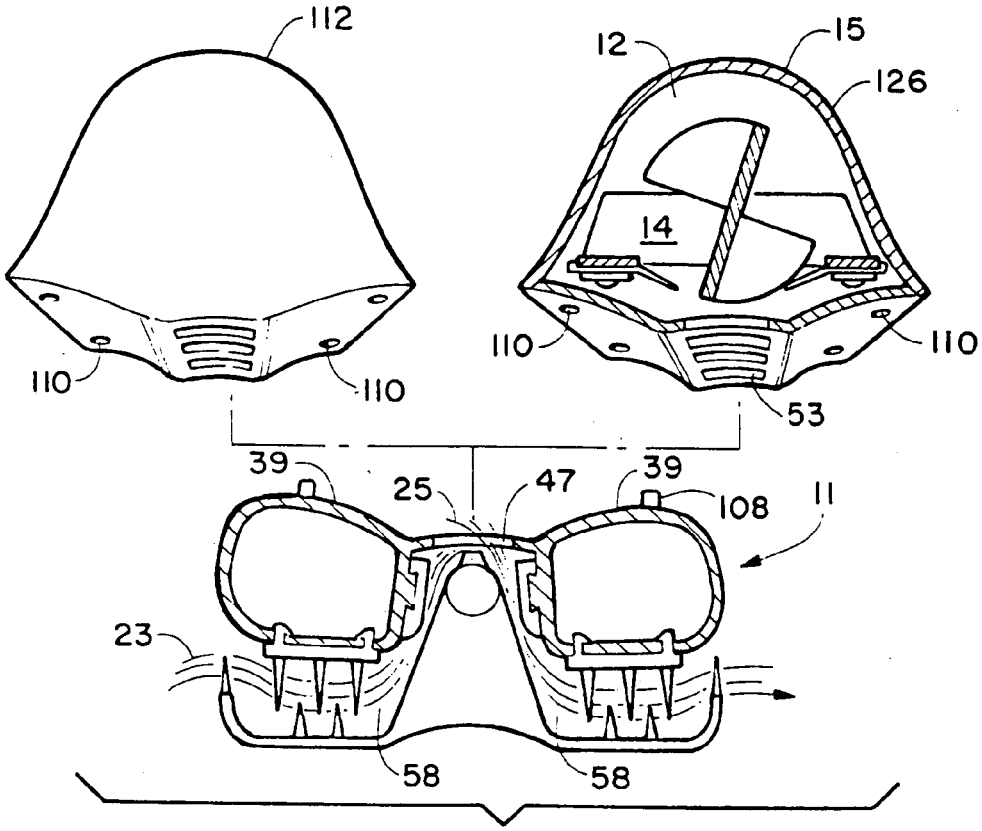
FIG. 6 depicts another preferred embodiment which provides rear facing mounts for attachable blade assemblies, a hair drying component, or when such components are removed, access to the hair communicating through the slot so that the ends may be shear trimmed by hand if desired.
Figure 7:
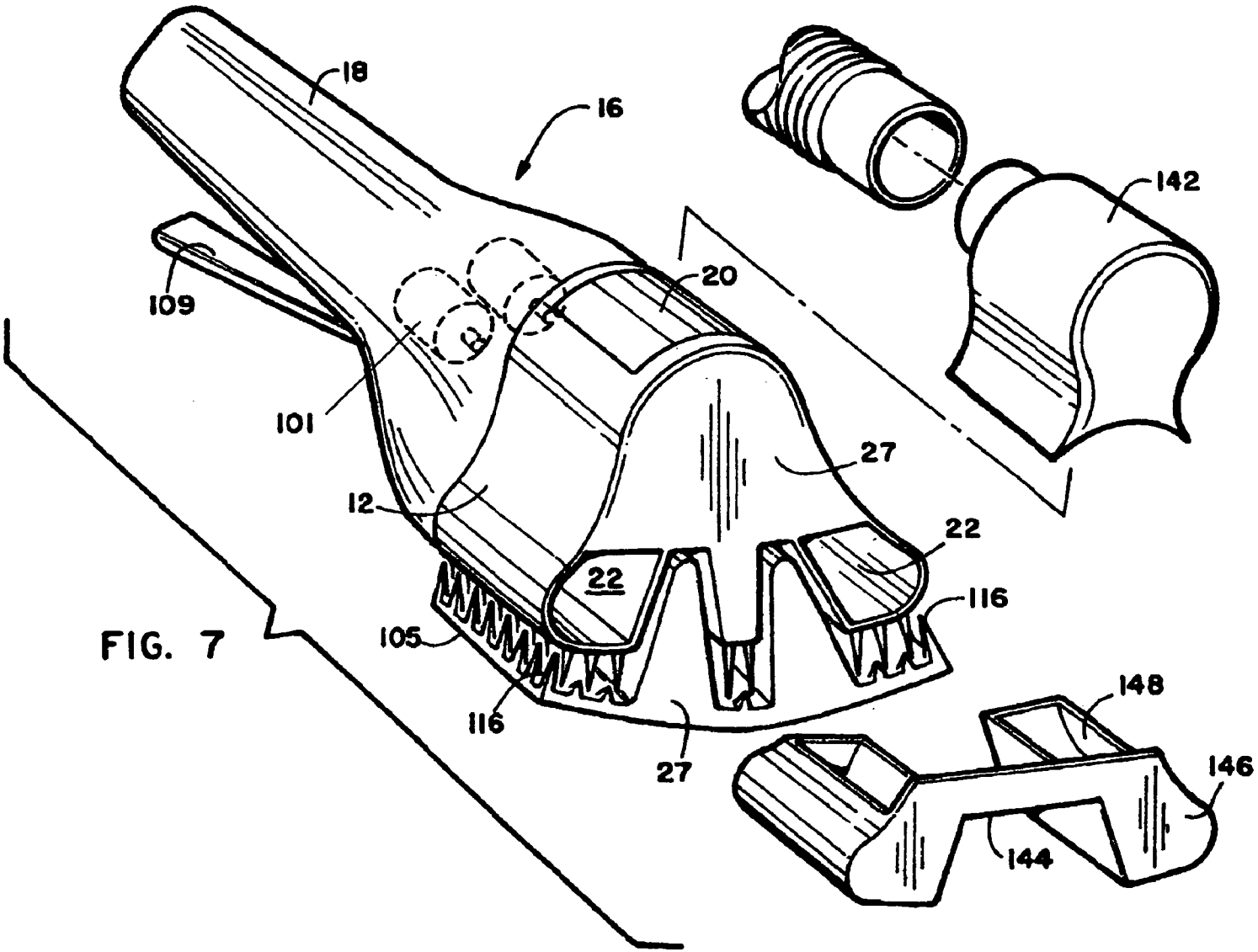
FIG. 7 depicts another preferred embodiment of the disclosed device and features a plurality of retainer cavities in-between at least two or more side lobes and a center lobe, a removable rear hatch for attachments, and an engageable hair collection tray.

Another preferred embodiment of the device 11 is depicted in FIGS. 6 and 7. This embodiment works in the same fashion as the above-mentioned embodiments in that it forms the serpentine pathway 58 for hair shafts 23 using the hinged retainer 105 cooperatively engaging in the retainer cavity 50. Hair shafts 23 drawn therethrough momentarily have their distal ends 25 pop up where they may be cut off in the aforementioned fashion.

This embodiment of the device 11 features a handle 18 having a front face 19 (FIG. 5) and a rear face 17. The first side lobe 38*a* and second side lobe 38*b*are attached to the handle 18. The retainer cavity 50 is thereby formed between first and second side lobes 38*a* and 38*b*, terminating at their communication to the handle 18. The elongated slot 55 is situated at the base of the retainer cavity 50 and communicates therethrough and in between the rear faces 39 of the first and second side lobes 38*a* and 38*b*.

The cutter blade assembly 14 is mounted in the cutter head assembly 12 which is attached to the cutter body assembly 16 all in one cutting unit assembly 15. This forms a cutting unit assembly 15 which mounts to the rear faces 39 of the first and second side lobes 38*a* and 38*b* using mounting pins 108 which are placed to register with and cooperatively engage mounting apertures 110 in the front face of the cutting unit assembly 15. A means to communicate electricity to the motor 101 in the cutting unit assembly 15 is provided by the mounting pins 108 also being electrical contacts which engage cooperative electrical contacts in the mounting apertures 110 which communicate with the drive motor 101 mounted inside the cutting unit assembly 15.

This secondary embodiment 11 allows for the easy mounting and dismounting of the entire cutting unit assembly 15 and thus the cutter blade assembly 14 in one quick action. Consequently, the device 11 could be provided with a plurality of differently configured cutting unit assemblies 15 which would be mountable using the mounting pins 108. With each such cutting unit assembly 15 being configured to cut a different defined length of hair from the distal ends of the hair shafts 23, the user can easily adjust the amount of hair being removed by simply changing to a different cutting unit assembly 15 which is configured to cut the specific length of hair from the distal ends 25 of the hair shafts 23. Power communicated through the mounting pins 108 could be provided in the aforementioned fashion from batteries stored in the handle 18 or AC power from a chord communicated to the mounting pins 108.

This alternate embodiment of the device 11 also affords additional functions and utility using the serpentine hair channel 58 which causes the distal ends 25 to pop up through the elongated slot 55. First when the cutting unit assembly 15 is removed, shears (not shown) could be used to cut very specific distal ends 25 when they rise through the elongated slot 55 and can be viewed. Second, a hair drying component 112 could also be supplied in the kit of attachable components. The hair drying component 112 would use conventional blow drying components of a heat source and fan and the device 11 could then be brushed through the hair of the user to dry and straighten the hair shafts 23. Power would be communicated to the fan motor 101 through the aforementioned mounting apertures 110 cooperatively engaging the mounting pins 108 in the same fashion as that of the cutting unit assembly 15. As such, using the serpentine hair channel 58 and the determined amount of rise of the distal ends 25 through the elongated slot 55, the various attachable components from the kit can be mounted to either cut more or less hair from the distal ends 25, dry the hair, or to allow the use of shears by hand.

FIG. 7 depicts another preferred embodiment of the disclosed device which provides a tray 144 which inserts into an aperture in the sidewall 27. The tray 144 would have collection cavities 148 which would catch the hair trimmed from the distal ends of the hairs entering the interior cavity 22 in the various embodiments of the device. Shown in FIG. 7, the tray 144 would also fit and work well in the other embodiments disclosed herein such as that in FIG. 4. The collection cavities 22 would be positioned so as to best catch substantially all of the trimmed hair, such as slidably engaged in one or more of the lobes 38 of the various embodiments. This tray 144 provides the user with an easily removably means to collect cut hairs, and once engaged in the mount adapted to hold it in the interior cavity, it will also provide a means to seal the apertures required to allow it to be placed in the interior cavity 22 to collect hair.

Figure 8:
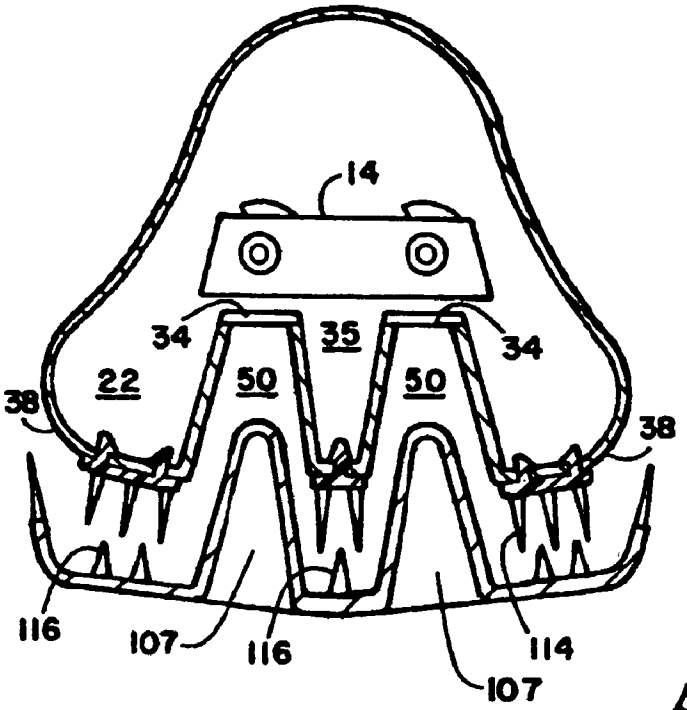
FIG. 8 depicts a side view of FIG. 7 and shows one version of a cutting means on the interior of the device and the faceplate engaging both cavities with a dual or multiple blade assembly.

Another feature of the additionally favored embodiment, as shown in FIGS. 7 and 8, is the plurality of retainer cavities 50 in between two side lobes 38 and a center lobe 35 located on the cutting head assembly 12. As shown, there are two such retainer cavities 50; however, more could be used if a progressive and multiple cut of the hairs following the serpentine path is desired. Each formed retainer cavity 50 would be mated to a projection 27 which would project from the hair retainer 109 and engage therein cooperatively. This embodiment, as shown offers a plurality of contacts between the distal ends of hairs traveling the serpentine path between the hair retainer 109 and the face of the cutting head assembly 12.

Figure 10:
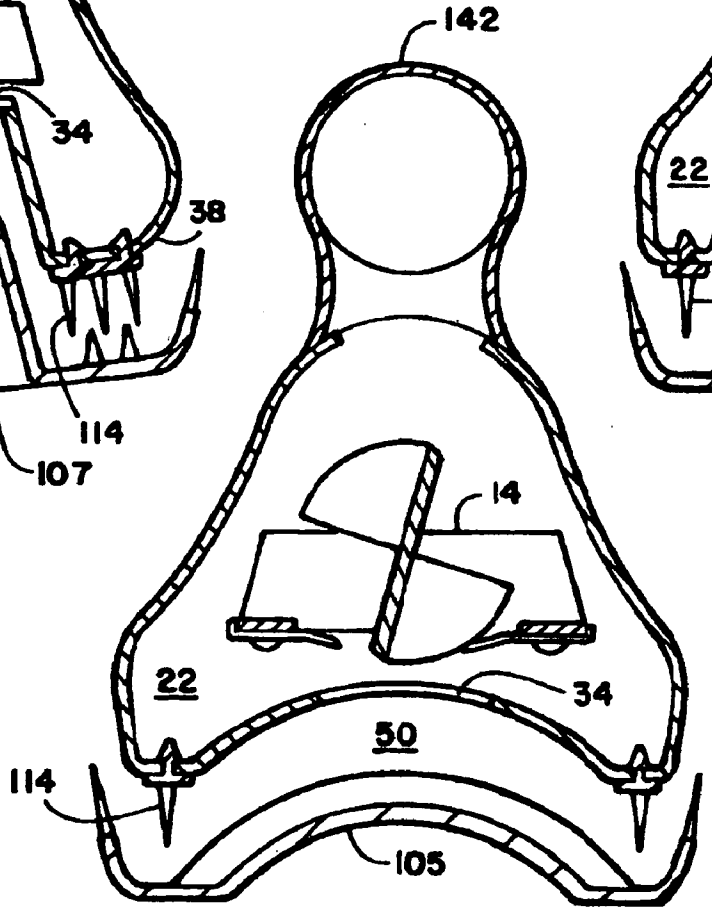
FIG. 10 shows a side view of another preferred embodiment of the device herein disclosed showing an arched retainer cavity with a cooperatively engaging faceplate and one of a plurality of optional attachments to the rear side of the device for drying or suction or other functions.

Also shown is a removable rear door 20 which provides a cover for the aperture which provides a communication to the interior cavity 22 for other components 142 as shown mounted in FIG. 10, which would be adapted for sealed engagement with the aperture in which the rear door 20 sits. Such other components can include a hair drying component that would provide hot or cool air to the interior cavity 22 or a vacuum that would be used to vacate the hair from the interior cavity 22 or to urge the entering distal ends of hairs towards the cutting means that will detach them.

FIG. 8 depicts a side view of FIG. 7 and shows one version of a cutting means in the form of a cutter blade assembly 14 that would be adapted for communication with the motor 101 providing power to rotate or translate or vibrate or otherwise cause the blades to cut the distal ends of hairs entering the interior cavity. This figure shows how the hairs would encounter the cutting means a plurality of times depending on how many of the retainer cavities 50 are provided which interface with the projections to form the serpentine path between the hair retainer 105 and the face of the cutting head assembly. Also shown in this figure is the plurality of splines 116 and 114 placed on one or a combination of the face or lobes of the cutting head assembly and the retainer 105. These splines, when aligned properly, will segregate the serpentine path into a plurality of serpentine paths aiding the orderly movement of hair through the device.

Figure 9:
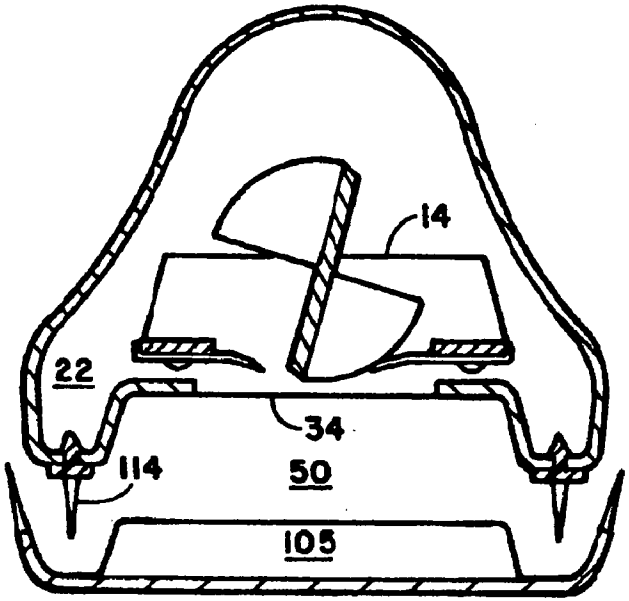
FIG. 9 depicts an additional preferred embodiment of the disclosed device showing an elongated cavity between two narrow side lobes.

FIG. 9 depicts an additional preferred embodiment of the disclosed device showing an arched shape to the retainer cavity 50 formed in the face and the retainer 105 of a shape to cooperatively interface with the retainer cavity 50.

FIG. 10 shows a side view of another preferred embodiment of the device herein disclosed showing an arched retainer cavity 50 with a flat area adjacent to the slot 34 with a cooperatively engaging retainer 105 with a similar and engaging shape.

The device herein shown in the drawings and described in detail in the specification and claims discloses arrangements of elements of particular construction and configuration, for illustrating preferred embodiments of structure and method of operation of the present invention. It is to be understood, however, that elements of different construction and configuration and other arrangements thereof, other than those illustrated and described, may be employed to provide the hair trimming device in accordance with the spirit of this invention. Any and all such changes, alternations and modifications as would occur to those skilled in the art are considered to be within the scope of this invention as broadly defined in the appended claims. Further, while the present invention has been described herein with reference to particular embodiments thereof, a latitude of modifications, various changes and substitutions are intended in the foregoing disclosure, and it will be appreciated that in some instance some features of the disclosed invention will be employed without a corresponding use of other features and/or in different combinations with other features without departing from the scope of the invention as set forth in the following claims.

What is claimed is:

1. A hair trimming apparatus for trimming the distal ends of hair drawn therethrough, comprising:

a body assembly having a handle end and having a head end;

a motor mounted in said body assembly adapted for communication with an electric power source;

a cutting head assembly positioned upon said head end of said body assembly, said cutting head assembly having a face with a retainer cavity formed therein, a rear wall, a sidewall, and an interior cavity defined by the area between said face and said rear wall;

a slot in said retainer cavity communicating between said face and said interior cavity;

an elongated hair retainer mounted to said body assembly at a first end, said hair retainer dimensioned for cooperative engagement in said retainer cavity;

said elongated hair retainer having an operating position cooperatively engaged in said retainer cavity and having a raised position, substantially disengaged from said retainer cavity;

means to move said elongated hair retainer between said raised position and said operating position;

a serpentine path formed between said retainer cavity and said hair retainer in said operating position, said serpentine path for drawing hair strands through said cutting head assembly;

said slot allowing said distal ends of said hair strands drawn through said serpentine path to momentarily communicate into said interior cavity; and means for cutting off portions of said distal ends of said hair strands;

means to communicate mechanical power from said motor to said means for cutting off portions of said distal ends of said hair strands.

2. The hair trimming apparatus as defined in claim 1 additionally comprising:

said cutting head assembly removably mountable to said head end; and means for cooperative engagement of said cutting head assembly to said head end.

3. The hair trimming apparatus as defined in claim 1 additionally comprising:

an aperture formed in said sidewall;

a tray, said tray engageable into said interior cavity through said aperture to a mounted position;

means to substantially seal said aperture when said tray is in said mounted position; and said tray having at least one collection cavity positioned to catch said portions cut from the distal ends of said hairs, whereby said portions cut from said distal ends of said hairs are collected in said collection cavity and thereafter can be disposed of by moving said tray from its mounted position and inverting it.

4. The hair trimming apparatus as defined in claim 2 additionally comprising:

an aperture formed in said sidewall;

a tray, said tray engageable into said interior cavity through said aperture to a mounted position;

means to substantially seal said aperture when said tray is in said mounted position; and said tray having at least one collection cavity positioned to catch said portions cut from the distal ends of said hairs, whereby said portions cut from said distal ends of said hairs are collected in said collection cavity and thereafter can be disposed of by moving said tray from its mounted position and inverting it.

5. The hair trimming apparatus as defined in claim 1 additionally comprising:

a rear aperture formed in said rear wall, said rear aperture providing communication to said interior cavity; and openable means for sealing said rear aperture.

6. The hair trimming apparatus as defined in claim 2 additionally comprising:

a rear aperture formed in said rear wall, said rear aperture providing communication to said interior cavity; and openable means for sealing said rear aperture.

7. The hair trimming apparatus as defined in claim 3 additionally comprising:

a rear aperture formed in said rear wall, said rear aperture providing communication to said interior cavity; and openable means for sealing said rear aperture.

8. The hair trimming apparatus as defined in claim 4 additionally comprising:

a rear aperture formed in said rear wall, said rear aperture providing communication to said interior cavity; and openable means for sealing said rear aperture.

9. The hair trimming apparatus as defined in claim 2 additionally comprising:

a plurality of cutter blade assemblies each either removably or permanently mountable in said interior cavity;

each of said plurality of cutter blade assemblies configured to cut a defined length of said distal ends of said hair strands whereby a user can adjust the length of said distal ends removed from said hair strands by changing to another cutter blade assembly from said plurality of cutter blade assemblies.

10. The hair trimming apparatus as defined in claim 4 additionally comprising:

a plurality of cutter blade assemblies each either removably or permanently mountable in said interior cavity;

each of said plurality of cutter blade assemblies configured to cut a defined length of said distal ends of said hair strands whereby a user can adjust the length of said distal ends removed from said hair strands by changing to another cutter blade assembly from said plurality of cutter blade assemblies.

11. The hair trimming apparatus as defined in claim 6 additionally comprising:

a plurality of cutter blade assemblies each either removably or permanently mountable in said interior cavity;

each of said plurality of cutter blade assemblies configured to cut a defined length of said distal ends of said hair strands whereby a user can adjust the length of said distal ends removed from said hair strands by changing to another cutter blade assembly from said plurality of cutter blade assemblies.

12. The hair trimming apparatus as defined in claim 5 additionally comprising:

said rear aperture engageable with one of a plurality of components from a group of engageable components consisting of a hair dryer and a vacuum.

13. The hair trimming apparatus as defined in claim 6 additionally comprising:

said rear aperture engageable with one of a plurality of components from a group of engageable components consisting of a hair dryer and a vacuum.

14. The hair trimming apparatus as defined in claim 7 additionally comprising:

said rear aperture engageable with one of a plurality of components from a group of engageable components consisting of a hair dryer and a vacuum.

15. The hair trimming apparatus as defined in claim 8 additionally comprising:

said rear aperture engageable with one of a plurality of components from a group of engageable components consisting of a hair dryer and a vacuum.

16. The hair trimming apparatus as defined in claim 1 additionally comprising:

said retainer cavity communicating between said face and said interior cavity being substantially arched shaped and extending from a point substantially adjacent to a first side edge of said face to a second point substantially adjacent to a second side edge of said face opposite said first side edge;

said elongated hair retainer also having arched shape dimensioned for cooperative engagement in said retainer cavity; and said slot positioned substantially equidistant between said first point and said second point.

17. The hair trimming apparatus as defined in claim 2 additionally comprising:

said retainer cavity communicating between said face and said interior cavity being substantially arched shaped and extending from a point substantially adjacent to a first side edge of said face to a second point substantially adjacent to a second side edge of said face opposite said first side edge;

said elongated hair retainer also having arched shape dimensioned for cooperative engagement in said retainer cavity; and said slot positioned substantially equidistant between said first point and said second point.

18. The hair trimming apparatus as defined in claim 3 additionally comprising:

said retainer cavity communicating between said face and said interior cavity being substantially arched shaped and extending from a point substantially adjacent to a first side edge of said face to a second point substantially adjacent to a second side edge of said face opposite said first side edge;

said elongated hair retainer also having arched shape dimensioned for cooperative engagement in said retainer cavity; and said slot positioned substantially equidistant between said first point and said second point.

19. The hair trimming apparatus as defined in claim 4 additionally comprising:

said retainer cavity communicating between said face and said interior cavity being substantially arched shaped and extending from a point substantially adjacent to a first side edge of said face to a second point substantially adjacent to a second side edge of said face opposite said first side edge;

said elongated hair retainer also having arched shape dimensioned for cooperative engagement in said retainer cavity; and said slot positioned substantially equidistant between said first point and said second point.

20. The hair trimming apparatus as defined in claim 5 additionally comprising:

said retainer cavity communicating between said face and said interior cavity being substantially arched shaped and extending from a point substantially adjacent to a first side edge of said face to a second point substantially adjacent to a second side edge of said face opposite said first side edge;

said elongated hair retainer also having arched shape dimensioned for cooperative engagement in said retainer cavity; and said slot positioned substantially equidistant between said first point and said second point.

21. The hair trimming apparatus as defined in claim 6 additionally comprising:

said retainer cavity communicating between said face and said interior cavity being substantially arched shaped and extending from a point substantially adjacent to a first side edge of said face to a second point substantially adjacent to a second side edge of said face opposite said first side edge;

said elongated hair retainer also having arched shape dimensioned for cooperative engagement in said retainer cavity; and said slot positioned substantially equidistant between said first point and said second point.

22. The hair trimming apparatus as defined in claim 7 additionally comprising:

said retainer cavity communicating between said face and said interior cavity being substantially arched shaped and extending from a point substantially adjacent to a first side edge of said face to a second point substantially adjacent to a second side edge of said face opposite said first side edge;

said elongated hair retainer also having arched shape dimensioned for cooperative engagement in said retainer cavity; and said slot positioned substantially equidistant between said first point and said second point.

23. A hair trimming apparatus for trimming the distal ends of hair drawn therethrough, comprising:

a body assembly having a handle end and having a head end;

a motor mounted in said body assembly adapted for communication with an electric power source;

a cutting head assembly positioned upon said head end of said body assembly, said cutting head assembly having a face having a plurality of retainer cavities formed therein, each of said plurality of said retainer cavities having a slot therein communicating between said face and an interior cavity;

an elongated hair retainer having a plurality of elongated projections, each of said projections dimensioned for cooperative engagement in said retainer cavities;

said elongated hair retainer having an operating position with said projections cooperatively engaged in said retainer cavities and having a raised position, with said projections substantially disengaged from said retainer cavities;

a serpentine path formed between each of said plurality of retainer cavities and said elongated projections; and each slot in said plurality of retainer cavities allowing said distal ends of said hair drawn through said serpentine path to momentarily communicate into said interior cavity, whereby portions of said distal ends of said hair communicate into said interior cavity a plurality of times substantially equal to the number of said plurality of retainer cavities.

24. The hair trimming apparatus as defined in claim 23 additionally comprising:

said cutting head assembly being removably mountable to said head end; and means for cooperative engagement of said cutting head assembly to said head end.

25. The hair trimming apparatus as defined in claim 23 additionally comprising:

an aperture formed in a sidewall of said body assembly;

a tray, said tray engageable into said interior cavity through said aperture to a mounted position;

means to substantially seal said aperture when said tray is in said mounted position; and said tray having at least one collection cavity positioned to catch said portions cut from the distal ends of said hair, whereby said portions cut from said distal ends of said hair are collected in said collection cavity and thereafter can be disposed of by moving said tray from its mounted position and inverting it.

26. The hair trimming apparatus as defined in claim 24 additionally comprising:

an aperture formed in a sidewall of said body assembly;

a tray, said tray engageable into said interior cavity through said aperture to a mounted position;

means to substantially seal said aperture when said tray is in said mounted position; and said tray having at least one collection cavity positioned to catch said portions cut from the distal ends of said hair, whereby said portions cut from said distal ends of said hair are collected in said collection cavity and thereafter can be disposed of by moving said tray from its mounted position and inverting it.

27. The hair trimming apparatus as defined in claim 23 additionally comprising:

a rear aperture formed in a rearwall of said body assembly, said rear aperture providing communication to said interior cavity; and openable means for sealing said rear aperture.

28. The hair trimming apparatus as defined in claim 24 additionally comprising:

a rear aperture formed in a rearwall of said body assembly, said rear aperture providing communication to said interior cavity; and openable means for sealing said rear aperture.

29. The hair trimming apparatus as defined in claim 25 additionally comprising:

a rear aperture formed in a rearwall of said body assembly, said rear aperture providing communication to said interior cavity; and openable means for sealing said rear aperture.

30. The hair trimming apparatus as defined in claim 26 additionally comprising:

a rear aperture formed in a rearwall of said body assembly, said rear aperture providing communication to said interior cavity; and openable means for sealing said rear aperture.

31. The hair trimming apparatus as defined in claim 1 additionally comprising:

a plurality of splines located on one or a combination of said hair retainer and said face;

gaps formed between said splines; and said gaps dividing said serpentine path into a plurality of individual serpentine pathways for guiding hair strands through said retainer cavity and said hair retainer.

32. The hair trimming apparatus as defined in claim 23 additionally comprising:

a plurality of splines located on one or a combination of said hair retainer and said face;

gaps formed between said splines; and said gaps dividing said serpentine path into a plurality of individual serpentine pathways for guiding hair strands through said plurality of retainer cavities and said hair retainer.

33. A hair trimming apparatus for trimming the distal ends of hair drawn therethrough, comprising:

a body assembly having a handle end and having a head end;

a cutting head assembly positioned upon said head end of said body assembly, said cutting head assembly having a face with a retainer cavity formed therein, a rear wall, a sidewall, and an interior cavity defined by the area between said face and said rear wall;

a slot in said retainer cavity communicating between said face and said interior cavity;

an elongated hair retainer mounted to said body assembly at a first end, said hair retainer dimensioned for cooperative engagement in said retainer cavity;

said elongated hair retainer having an operating position cooperatively engaged in said retainer cavity and having a raised position, substantially disengaged from said retainer cavity;

means to move said elongated hair retainer between said raised position and said operating position;

a serpentine path formed between said retainer cavity and said hair retainer in said operating position, said serpentine path for drawing hair strands through said cutting head assembly;

said slot allowing said distal ends of said hair strands drawn through said serpentine path to momentarily communicate into said interior cavity; and means for cutting off portions of said distal ends of said hair strands which communicate into said interior cavity.

* * * * *